US007686357B2

(12) United States Patent
Engel et al.

(10) Patent No.: US 7,686,357 B2
(45) Date of Patent: Mar. 30, 2010

(54) OPERATING MECHANISM

(75) Inventors: Heinz-Eckhard Engel, Glurns (IT); Rudolf Stieger, Laas (IT); Christian Josef Stephan Zeus, Stilfs (IT)

(73) Assignee: Hoppe AG (IT)

( * ) Notice: Subject to any disclaimer, the term of this patent is extended or adjusted under 35 U.S.C. 154(b) by 179 days.

(21) Appl. No.: 11/332,268

(22) Filed: Jan. 17, 2006

(65) Prior Publication Data

US 2006/0202491 A1 Sep. 14, 2006

(30) Foreign Application Priority Data

Jan. 17, 2005 (DE) ..... 20 2005 000 785 U
Nov. 7, 2005 (DE) ..... 20 2005 017 497 U

(51) Int. Cl.
*E05C 19/14* (2006.01)
*E05C 5/00* (2006.01)

(52) U.S. Cl. ..... 292/347; 292/348; 292/352

(58) Field of Classification Search ..... 292/347, 292/348 X, 352 X, 355
See application file for complete search history.

(56) References Cited

FOREIGN PATENT DOCUMENTS

| | | |
|---|---|---|
| DE | 1937220 | 2/1970 |
| DE | 1927916 | 12/1970 |
| DE | 2024652 | 12/1971 |
| EP | 0235385 B1 | 9/1987 |
| EP | 0436795 B1 | 7/1991 |

*Primary Examiner*—Peter M. Cuomo
*Assistant Examiner*—Mark Williams
(74) *Attorney, Agent, or Firm*—Reinhart Boerner Van Deuren s.c.

(57) ABSTRACT

An operating mechanism for building components such as windows, doors and the like comprises at least one handle and an actuating element that ca be made to engage the handle in a mutually non-rotational manner. A blocking device is situated between the handle and the actuating element and is designed so that the actuating element is insertable in a first direction into the handle whereas its displacement in the opposite direction is blocked.

24 Claims, 6 Drawing Sheets

OPERATING MECHANISM

FIELD OF THE INVENTION

The present invention relates to operating mechanisms for building components such as windows, doors and the like.

BACKGROUND OF THE INVENTION

Such operating mechanisms are known in numerous designs. Illustratively they are used to open and close a window, a door or the like, a handle being designed to rotate—most often using an actuating element such as a spindle, hereafter "square bar"—a drive system, for instance a window drive or a door lock socket, the latter hereafter being called "lock 'hub'".

In general the actuating element must transmit in addition to torques also axial tractions for instance to door fittings. The linkage between the handle and the actuating element therefore must be designed that they shall be firmly anchored to each other both axially and irrotationally after installation, and, depending on the window or door design, the square bar connection must be matchable to the particular thickness of the window frame or door wing.

For that purpose the German patent documents 1,927,916 U1 or 1,937,220 U1 employ square bars divided each in two, where substantially wide slots fitted with wedging surfaces are fitted to the ends of the two bar halves, said wedging surfaces tapering in two directions and an expansion screw engaging in-between said surfaces. The elongated geometry of said slots allows affixing the square bar in axially variable manner and thereby to adapt to the particular door thickness. The expansion screw turned into the handle neck however may project from the handle, being unesthetic and also a potential for injury. Moreover manufacture is fairly costly because each square bar requires both a right-hand and a left-hand half a bar; production and storage therefore are doubly onerous. Installation is cumbersome and requires tools.

The German document 86 05 427 U1 uses a specially designed threaded rod to implement door handle connection, said rod acting on external edges above longitudinal grooves of two similar/identical square bar halves between which it shall be compressed when being screwed into them. The onion-like tip of the threaded rod rests in a V-shaped cavity against the displaced material of the halves of the square bar. This design also requires separate fitting and installation to affix the actuating element in the handle, the strength of the mechanical connection depending on the appropriate affixation of the threaded rod. This rod impairs the surfaces and edges of the square bar halves in lasting manner, and as a result repeated installation is possible only conditionally. Furthermore when being sufficiently stressed, the square bar halves may shift relative to each other, in which event durable axial affixation may become problematical.

Other improvements in axial dimensional stability and in meeting manufacturing tolerances make use of solid square bars in conjunction with slotted leaf spring elements or corrugated springs (see for instance the German patent document DE 2,024,652 A). In the European patent document EP 0,436,795 B1, the connecting bar is fitted with a continuous longitudinal groove at one side and with a terminal blind hole comprising shoulders to support the angled ends of an elongated leaf spring. The longitudinal groove in the square bar helps inserting the mounting screw into a terminal leaf spring longitudinal slot which is narrower than the terminal widening of the mounting screw. In this manner it includes a special stress because the leaf spring's corrugated zone axially locks the connecting bar in the lock hub. Both manufacture and storage of such a connection system are also onerous. Installation requires several elements and the particular applicable tool always must be at hand.

BRIEF SUMMARY OF THE INVENTION

The objective of the present invention is to overcome the above and other drawbacks of the state of the art and to create an operating mechanism allowing reliable connection between the handle and the actuating element without resort to any tool. The connection of the invention is applicable to various thicknesses of frames and wings and even to durably withstand higher loads. A further goal of the present invention is economical design as well as dismantling the system of the invention if called for, also simple handling. Moreover the system of the invention shall be reusable even after repeated disassembly.

The main features of the present invention are defined in claim 1 and in claims 2 through 24.

As regards an operating mechanism for building components such as windows, doors and the like that comprises at least one handle and one actuating element which may be irrotationally linked to said handle, the present invention provides that a blocking device—which allows inserting in a first direction the actuating element into the handle while blocking it in the opposite direction—be configured between said handle and actuating element.

This design allows both simple and rapid installation of the operating mechanism without resort to any tool. Most of the time the actuating element will be a square bar that is inserted conventionally into the handle. However aid square bar no longer can be pulled out in the opposite direction because said blocking device acts as a blocking device or the like and affixes the actuating element into the handle. The depth of the actuating element insertion no longer matters. As soon as the pawl or the like has seized the actuating element, the latter is fixed in position, preferably axially and cannot be easily pulled out. This feature allows servicing different door and window frame thicknesses automatically, namely the handle is inserted until it comes to rest and thereafter it shall rest without slack against its stop plate or the particular component. Said blocking device affixes the actuating element in such manner in the handle that the operating mechanism shall permanently withstand even high loads. Accidental loosening or full detachment is precluded. When being affixed, the square bar is neither visibly damaged nor warped, and re-use is assured following disassembly.

BRIEF DESCRIPTION OF THE DRAWINGS

Further features, details and advantages of the present invention are elucidated in the claims and in the descriptions below of illustrative embodiments shown in the appended Figures.

DETAILED DESCRIPTION OF THE INVENTION

Figure 1:
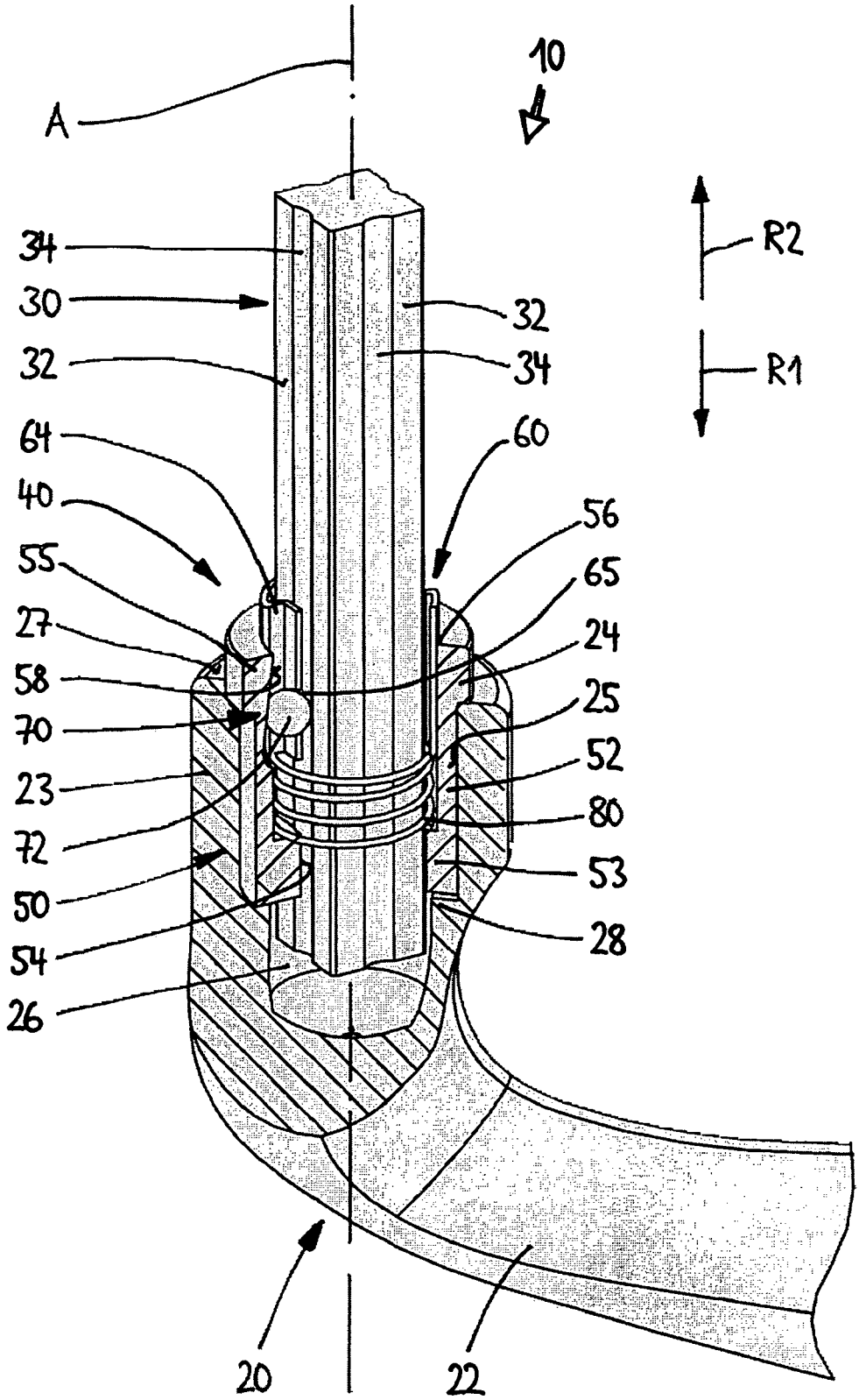
FIG. 1 is a schematic, partial view of an operating mechanism fitted with a blocking device partly in section.

The operating mechanism denoted overall by 10 in FIG. 1 is a component of a door fitting comprising a handle 20 on each side of an omitted door wing. Each handle 20 comprises a main handle element 22 and a handle neck 23 rotatably resting by a shoulder or handle collar 24 in an omitted door plate. The latter are preferably affixed by omitted screws to the door leaf.

Both cooperating handles 20 are connected irrotationally and in axially fixed manner to each other through the door leaf by an actuating element 30 which preferably is a square bar. This square bar 30 passes through the lock hub of an omitted plug-in lock inserted on edge into the door leaf, where the door handle (masked in FIG. 1) preferably is affixed by means of a factory premounted clamp or Allen screw onto the square bar 30.

The door handle 20 shown in FIG. 1 is affixed by a blocking device 40 to the square bar 30. This blocking device 40 is designed to be automatically blocking in a manner that the square bar 30 can be inserted without significant impedance into the blocking device 40 and hence into the handle neck 23 in a first direction R1 preferably running parallel to the longitudinal axis A of said bar 30 until each handle 20 rests by its neck 23 against the door shield. If otherwise the handle 20 were pulled in the opposite direction R2, away from the square bar 30, then the blocking device 40 shall at once block said bar against such a motion, i.e. the bar no longer can be pulled out of the handle neck 23. In this process the blocking device 40 keeps in place the square bar 30 in a manner that both door handles 20 are affixed not only irrotationally, but also in axially immovable and playless manner to the door leaf without recourse to any tool.

In the embodiment mode of FIG. 1, the blocking device 40 rests at one end in a recess 25 in the handle neck 23. The blocking device 40 comprises a bush 50 with a cylindrical casing 52 that, at its end situated in the handle neck comprises a base 53 and at its external end a flange-like collar 55. Said collar 55 rests against the end surface 27 of the handle neck 23 and preferably its dimensions are selected in a way that said collar shall constitute the protrusion, i.e. the gripping collar 24 of the handle 20.

Figure 2:
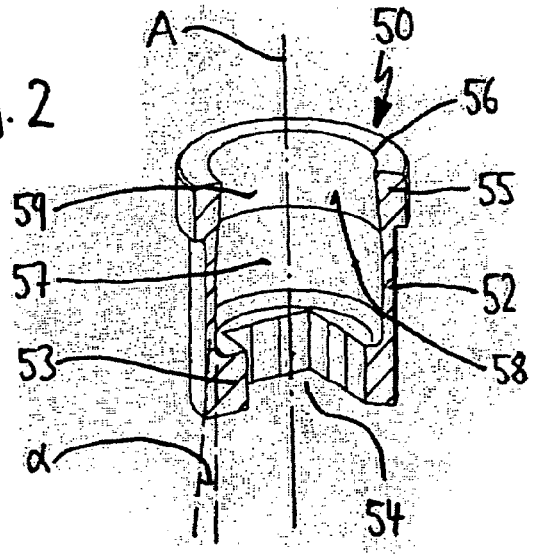
FIG. 2 shows a sleeve for a blocking device.

The bush 50 is solidly anchored in the recess 25, for instance being force inserted, snapped-in or screwed in. However said bush also may be integrated in other ways into the handle neck, for instance by bonding or welding. A square recess 54 is present in the base 53 and is centered on the longitudinal axis A to receive the square bar 30 (FIG. 2) in irrotational and mechanically interlocking manner. The inner portion 26 of the clearance 25 in the handle 20 also may be made square underneath a step or offset 28 to also receive the square bar 30 in irrotational and mechanically interlocking manner. In this case care must be paid during installation of the bush 50 that the clearance 54 in the base 53 and the clearance 25 in the handle neck 23 are congruently positioned.

Externally oblique surfaces 58 are subtended at the inside periphery 57 of the bush 50 underneath the top edge 56 of the collar 55. Said surfaces 56 subtend an angle $\alpha$ with the longitudinal axis A of the square bar 30, i.e. its lateral faces 32. They run approximately as far as half the inside height of the bush 50. In the embodiment mode of FIG. 2, the oblique surfaces 58 in the bush 50 are not manufactured separately. On the contrary, in this instance, they subtend a continuous conical peripheral surface 59, as a result of which the manufacture of the bush 50 and hence of the blocking device 40 are simplified.

Figure 3:
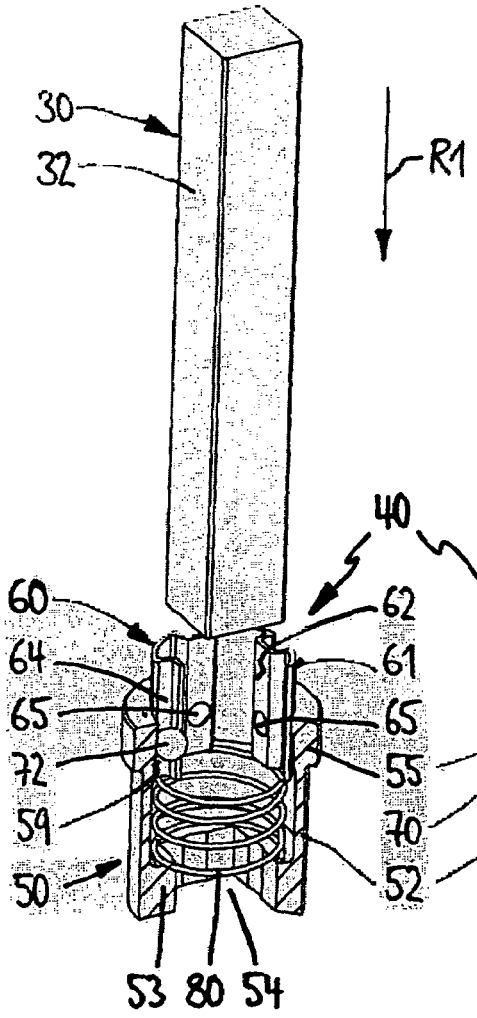
FIG. 3 shows a blocking device without the square bar being installed in it.
Figure 4:
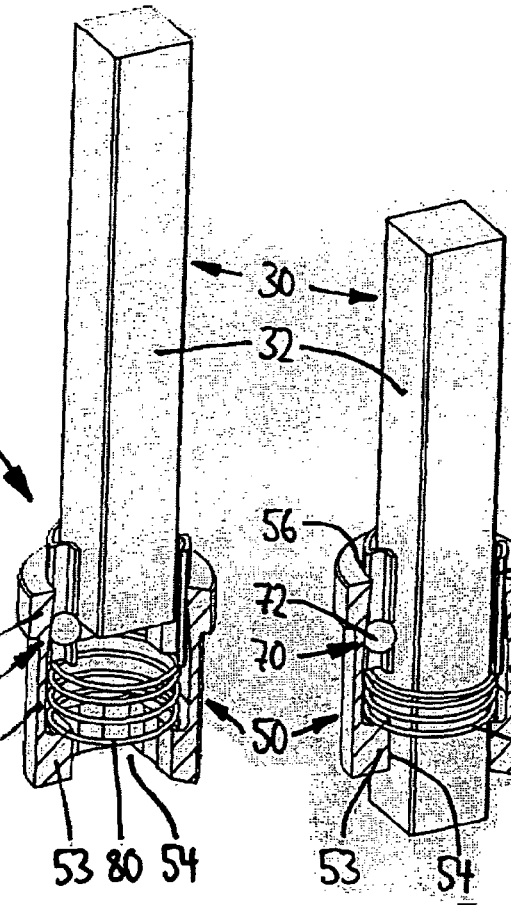
FIG. 4 shows the blocking device of FIG. 3 when the square bar is partly inserted.
Figure 5:
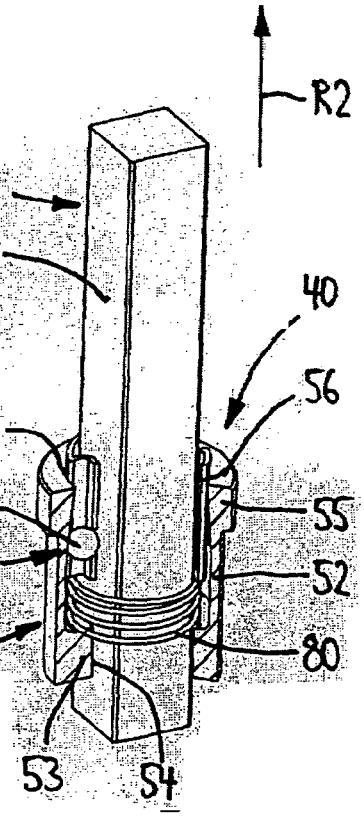
FIG. 5 shows the blocking device of FIG. 3 when the square bar is fully inserted.

A guide element 60 is mounted in axially displaceable manner inside the bush 50 and comprises a substantially cylindrical outer periphery 61 and a substantially square inner periphery 62 (FIGS. 3 through 5). The diameter of the outer periphery 61 corresponds to the smallest diameter of the inner periphery 57 of the bush 50 except for small play, whereas the dimensions of the inner periphery 62 correspond to the cross-sectional dimensions of the square bar 30 which is longitudinally displaceable with little play into the guide element 60.

Four displaceable blocking elements 70 each illustratively in the form of spheres 72 are configured within said blocking device 40 between the preferably metallic bush 50 and the guide element 60 which may be made of metal or plastic for the purpose of affixing the square bar 30 within the blocking device 40. Each sphere 72 is seated within a channel 64 of the guide element 60 running parallel to the longitudinal axis A, said element 60 being fitted with a hole 65 on each of the lateral faces of the inner periphery 62 facing the square bar 30. The diameter of the holes 65 is selected in such manner with respect to the outer diameter of the spheres 72 that said spheres may project by part of their external surface through said holes while still being precluded from falling inside the guide element 60.

The guide element 60 is configured within the bush 50 in a manner that the inside periphery 62 is situated congruently with the clearance 54 in the base 53. At the same time the channels 64 by their holes 65 are opposite the oblique surfaces 58, 59 of the bush 50 to allow the spheres 72 to rest in them.

A preferably helical spring 80 is mounted underneath the guide element 60 and rests on the base 53 of the bush 50 and permanently and elastically biases the guide element 60 in the axial direction A, i.e. in the direction R2. At the same time the blocking elements 70, i.e. 72 configured between the oblique surfaces 58, 59 of the bush 50 and the lateral faces 32 of the square bar 30 are permanently loaded in the axial direction A, the spheres 72 guided in the channels 64 of the guide element 60 and partly passing through the holes 65 being pressed radially inward by the oblique surfaces 58, 59, whereby the spheres 72 always rest in frictionally locking manner against the lateral faces 32 of the square bar 30.

Because the distance between the upper edge 56 of the collar 55 and the guide element 60 always is small enough, the spheres 72 cannot move outward, even when the square bar 30 is outside, uninserted in the guide element 60. As a result said guide element is always secured in place axially. As shown in FIG. 3, the guide element 60 cannot drop out of the bush 50. If and when called for, the entire blocking device 40 therefore can be manufactured as a preassembled unit, whereby further advantages are attained beyond those relating to storage and logistics.

Also the guide element 60 may be axially secured by omitted pins or screws radially inserted into the collar 55 and engaging omitted axial slots or recesses in this guide element 60. At the same time said pins or screws assure irrotational configuration. Alternatively or complementarily, the guide element 60 also may be fitted with omitted radial protrusions or external pegs engaging corresponding guide clearances in the bush 50.

The operating mechanism 10 may be installed in exceedingly simple manner in the door leaf and takes place without resort to any tool.

In FIG. 3 the square bar 30 is situated outside the handle 20 and therefore outside the blocking device 40. After the omitted bar component of the operating mechanism 10 was preinstalled from one side of the door leaf through the lock hub, the handle 20 jointly with the blocking device 40 will be mounted on the free end of the square bar 30. As shown in FIG. 4, said square bar initially enters the guide element 60 until it reaches the laterally mounted spheres 70.

If the square bar 30 is advanced further in the direction R1 into the blocking device 40, the spheres 72 initially are moved inward and outward, this being feasible because the outwardly and inwardly flaring surfaces 58, 59 allow the spheres 70 to move out of the way. In the process, the guide element 60 is also moved inward against the force of the compression spring 80 by means of the spheres 72 situated in the holes 65 until the spheres 72 come to rest against the lateral faces 32 of the square bar 30 (FIG. 5).

Next the handles 20 situated on both sides of the door leaf are displaced toward each other until the handle necks 23 rest against the particular door plates and the handle collars 26 of each side engage the omitted support apertures of the door plates. The door leaf dimensions or the means affixing the door plates to the door leaf are no longer factors. What does remain significant is that the blocking elements 70 shall grab the square bar 30, i.e., that now the spheres 72 do rest against the lateral faces 32.

After installation, if the attempt were made to pull apart the door handles 20 in the opposite direction R2, then the spheres 72 would tend to roll off the oblique surfaces 58, 59 and the lateral faces 32 of the square bar 30, but they are precluded from doing so because being directly clamped between the surfaces 32 and 58,59 which are configured in wedging manner. The frictional affixation so generated prevents the square bar 30 from detaching off the blocking device 40 and hence off the handle 20. Instead this handle 20 is stopped at the square bar 30 without need for a tool. When the square bar 30 enters the clearance 54 in the base 53 of the bush 50, the handle 20 is connected by the blocking device 40 not only in axially fixed manner but also rotationally relative to the square bar 30.

It is understood that the entire installation of the operating mechanism of the invention is restricted to axially joining the square bar and the handle 20. Neither screws need being tightened nor other fasteners be operated or assembled. Handling is as simple as conceivable and exceedingly reliable, the blocking elements 70 being permanently biased by the compression spring 80 and without play against the oblique surfaces 58, 59 of the bush 50 and the lateral faces 32 of the square bar 30. As soon as said bar is acted on to displace it in the direction R2, the permanently force-biased operating elements 30, 50, 70 of the blocking device 40 shall intervene, and consequently the square bar 30 is stopped/fixed in place virtually without any play.

On the other hand, the square bar 30 may be displaced anytime in the direction of installation R1 until the handles 20 come to rest against the door plates. Accordingly, already during installation, the blocking device 40 allows automatically matching the bar connection to the particular door leaf thickness. The handles 20 always rest jitter-free against the door plates.

To further enhance the frictional/clamping effect between the blocking spheres 72 and the square bar 30, channels or longitudinal grooves 34 running parallel to the longitudinal axis A may be fitted into the lateral faces 32 of the square bar 30, said channels/grooves being cross-sectionally half-circular. The diameter of each longitudinal groove 34 then corresponds to the outside diameter of the spheres 72 which thereby rest not by point stresses but by line contact against the square bar 30. In this manner anchoring in the blocking device 40 shall durably withstand even large loads.

As regards any disassembly of the operating mechanism 10 that might arise, use may be made of an omitted actuation component or the like which shall axially displace the guide element 60 and/or the blocking elements 70 in the direction R1. Said blocking elements as a result may escape radially outward through the holes 65 and the square bar 30 then may be pulled out of the blocking device 40 without encountering significant impedance. To allow access to the guide element 60, same may always protrude somewhat from the bush 50.

Figure 6:
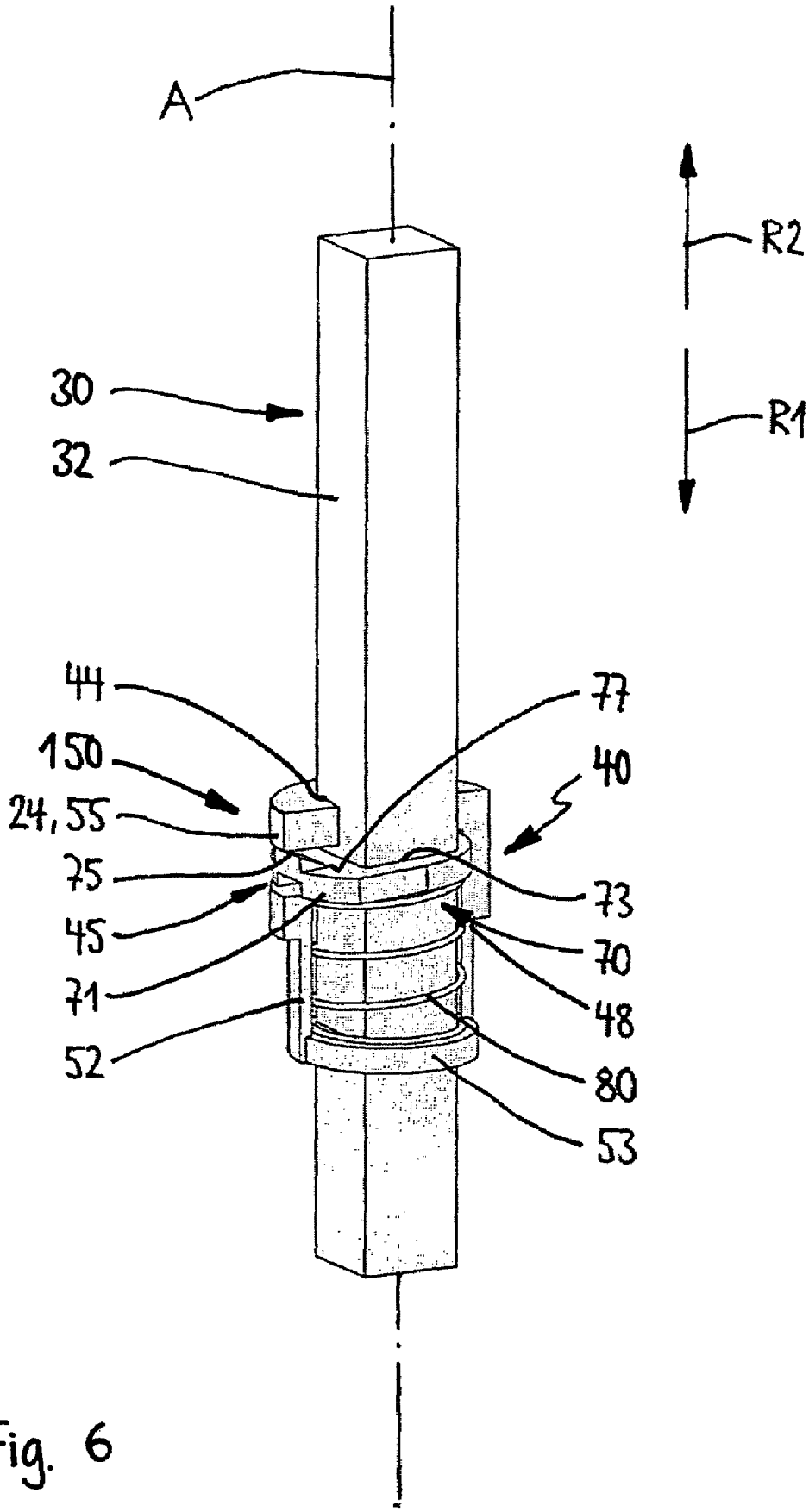
FIG. 6 is another embodiment mode of a blocking device with inserted square bar.

FIG. 6 shows a simplified embodiment mode of an operating mechanism 10 comprising a blocking device 40. This device 40 also is designed in a manner to allow inserting the actuating element 30 into the omitted handle 20 in a first direction R1, whereas pulling said actuating element 30 out of the handle 20 in the opposite direction R2 shall be blocked at once.

A bush 150 is firmly mounted by means of a cylindrical casing 52 in the clearance 25 in the (omitted here) neck 23 of the handle 20, preferably being screwed or forced into it. The axially raised and flange-like collar 55 rests by a lip 48 against an upper step 21 in the handle neck 23 (see FIG. 7), subtending thereby a handle collar 24 above the handle neck 23.

The collar 55 is fitted laterally with a clearance 45 running transversely to the longitudinal axis A and receiving, with displacement play and like a drawer, an approximately circular clamping frame 71. The frame 71 comprises a central polygonal clearance 73 situated congruently with the clearance 44 in the collar 55 and of which the inside width is larger at least in the longitudinal direction of the clearance 45 than the cross-sectional dimension of the square bar 30. A support edge 75 is formed transversely to the longitudinal axis A and parallel to a lateral face 32 of the square bar 30 and is situated slightly higher in the axial direction A than the frame top side 77 and illustratively was formed by being bent at right angles. As a result the clamping frame 71 rests unilaterally at the lower side, not discussed further, of the clearance 45 in the collar 55 and constitutes a blocking/clamping element 70 situated obliquely to the axial direction A, whereby two mutually opposite edges, not further discussed, of the clearance 73 may be made to engage the lateral faces 32 of the square bar 30.

The spring 80 biasing the clamping frame 71 and hence the blocking element 70 in the axial direction A, i.e. in the direction R2, is situated between the clamping frame 71 and the base 53 of the bush 150. The dimensions of the inside height of the clearance 45 in the collar 55 and of the height of the support edge 75 opposite the top side 77 of the clamping frame 71 are selected in a way that the clamping frame 71 always is able to assume its oblique position relative to the square bar 30.

When the square bar 30 is guided in the direction of installation R1 into the blocking device 40, i.e. into the handle 20, then the oblique clamping frame 71 is pivoted downward and out of its oblique position against the force of the spring 80. The pivoting motion takes place parallel to the lateral faces 32 of the square bar 30 and about the lateral support edge 75. The square bar 30 is able to freely enter the clearance 73 in the clamping frame 71, the edges of the clearance 73 sliding along the lateral faces 32 of the square bar 30.

When, on the other hand, the square bar 30 is pulled in the opposite direction R2, the clamping frame 71 biased by the spring 80 remains in its oblique position and the edges of the clearance 73 already resting against the lateral faces 32 of the square bar 30 are forced into this bar. This clamping effect arises at once and prevents the square bar 30 from loosening off the blocking device 40 and hence off the handle 20. Appropriately, to attain a high clamping force, the support edge 75 is configured a maximum distance from the longitudinal axis A.

In this embodiment mode also the handle 20 may be firmly connected to the square bar 30 without resorting to a tool. After the bar component of the operating mechanism 10 of the invention has been inserted from one side of the door leaf into the lock hub, no more need be done than plugging the still absent handle 20 together with the blocking device 40 onto the free end of the square bar 30. Installation has been completed as soon as both handles 20 rest against the door plates. A durable and reliable connection between the actuating element 30 and the handle 20 has been attained, which automatically adapts to different frame and wing thicknesses.

The embodiment mode shown in FIG. 6 offers another advantage in that it significantly reduces the number of components. Instead of the case of 4 or more blocking elements 70 configured in a separate guide element 60, the embodiment mode of FIG. 6 now requires, within the bush 150, only one pivotably supported clamping frame 71 which encloses the square bar 30. High clamping effectiveness is attained by the edges of the clearance 73 in the frame 71 that run parallel to the lateral faces 32 of the square bar 30, whereby the operating mechanism 10 of the invention durably withstands even high loads.

FIG. 6 shows the clamping frame 71 engaging the square bar 30. Said bar rests radially and peripherally in the square bar clearance 44 of the collar 55 and is guided radially in the bush base 53. The clamping frame 71 is supported in floating manner in the (shaft) clearance 45 and in this manner may be aligned with the square bar 30. This feature allows inserting smoothly the square bar 30 into the blocking device 40 while nevertheless assuring geometric interlock between the clamping edges of the clamping frame 71 and the lateral faces 32 of the square bar 30.

The (shaft) clearance 45 is configured in the collar 55 of the bush 150 in a manner that following installation of the blocking device 40 in the handle neck 23 it shall be completely covered. As a result the clamping frame 71 is prevented from dropping out even when the square bar 30 is uninserted.

Figure 7:
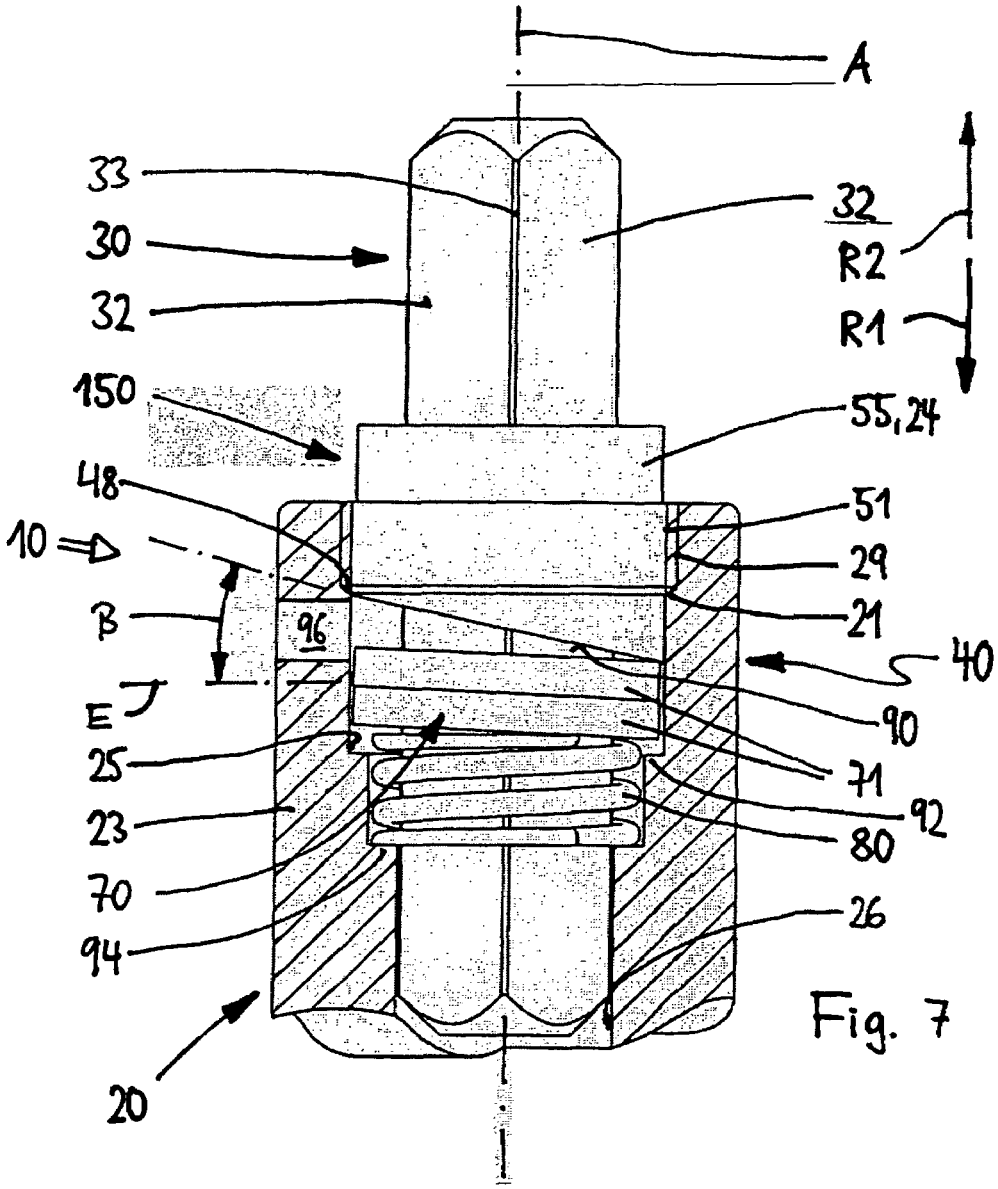
FIG. 7 is a partial view of a further embodiment mode of an operating mechanism blocking device in partial view.

To further simplify the overall design of the operating mechanism 10 of the invention, in particular of the blocking device 40, the number of different components is reduced to a total of three in the embodiment mode of FIG. 7, thereby advantageously affecting both assembly costs and even more manufacturing costs.

Contrary to the case of previous designs, the bush 150 is without a cylindrical casing 52 and without a base 53, instead only retaining a collar 55 which is fitted for instance with an external thread 51 to affix the blocking device 40 in the handle neck 23. Said thread engages a matching inside thread 29 at the edge zone of handle neck 23. The outside diameter of the collar 55 is reduced above the thread 51, to form a step or collar 24 of the handle 20. The stepped lip 48 is situated below the thread 51 and constitutes an axial stop for the bush 150 at the offset 21 of the clearance 25 in the handle neck 23.

Figure 8:
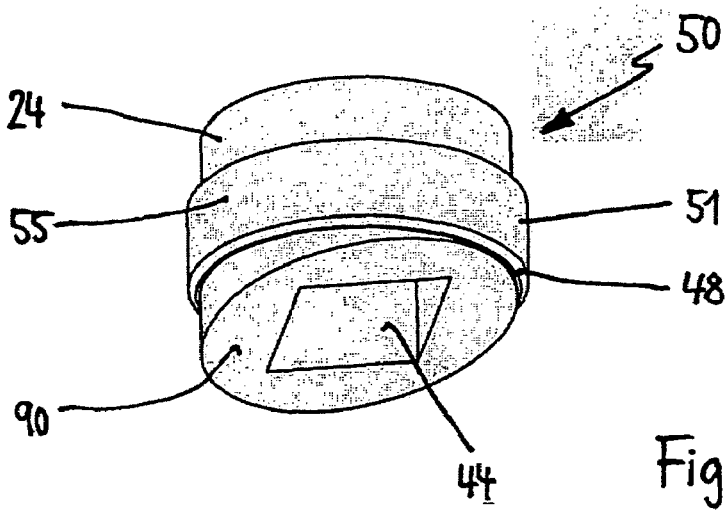
FIG. 8 is an oblique view of the bush of the blocking device of FIG. 7.

Below the lip 48, the bush 150 acting as a flange lid is fitted at its end with a planar but oblique surface 90 subtending an angle β with a plane E perpendicular to the axial direction A. FIG. 8 shows that the direction of inclination of the oblique surface 90 runs diagonally to the cross-section of the square bar 30 being irrotationally received in a near congruent clearance 44 in the bush 150.

Two axially superposed clamping frames 71 are situated between the oblique surface 90 of the bush 150 and a further radially contracting offset 92 of the clearance 25 of the handle neck 23, said frames 71 enclosing the square bar 30 on all sides. Each frame 71 is centrally fitted with a polygonal clearance 73 (FIG. 10) of dimensions sufficiently larger than the outside dimensions of the square bar 30 to assure that both frames 71 may come to rest obliquely to the plane E. It is important that the clearances 73 be aligned with the clearance 44 in the collar 55 to allow freely inserting the square bar 30 into the blocking device 40. The inside portion 26 of the clearance 25 also may be made square below a lower offset 94 in the handle neck 23 in order to receive the square bar 30 in geometrically locking manner.

The identical and superposed clamping frames 71 constitute the clamping elements 70 of the invention of the blocking device 40. They are biased in the direction R2 by a force applied by the helical spring 80. Said spring rests inside the handle neck 23 against the lower offset 94 and presses the clamping frames 71 against the oblique surface 90.

The square bar portion (again omitted) of the operating mechanism 10 of the invention is inserted from one side of the door leaf into the lock hub to install said mechanism in place. Thereupon the handle 20 together with the blocking device 40 is plugged onto the free end of the square bar 30. Said bar then enters the clearance 44 of the bush 150 until it arrives at the oblique clamping frames 71.

When the square bar 30 is inserted farther in the direction R1 into the blocking device 40, i.e. into the handle 20, then the oblique clamping frames 71 will be pivoted out of their oblique position and downward against the opposition of the spring 80. Because of the attitude of the oblique surface 90, said pivoting motion always takes place diagonally to the cross-section of the square bar 30. In the process the edges of the clearances 73 initially slide along the square bar 30. Said bar is able to freely enter the clearances 73 of the clamping frames 71 and hence it can enter the blocking device 40.

On the other hand, if a traction is applied to the square bar 30 in the opposite direction R2 (out of the handle 20), the clamping frames 71, which are permanently biased by the spring 80 into their diagonal oblique position relative to the said bar 30 immediately engage the corner edges 33 and the lateral faces 32 of the square bar 30. Said bar is blocked in place at once, the clamping effectiveness by means of the corner edges 33 of the square bar 30 being significantly higher than mere clamping by only said bar's lateral faces 32.

The oblique surface 90 of the bush 150 assures that the clamping frames 71 always subtend a maximally large lever arm. A separate support edge acting as an axis of rotation is not needed. On the contrary, the clamping surfaces 71 may be manufactured economically in the form of simple panes that merely require being fitted for instance by stamping with square apertures 73. The bush 150 also is geometrically simple and preferably is made as an economical cast component.

The handle 20 can be firmly joined to the square bar 30 without resorting to tools. As soon as both handles 20 rest against the door plates, there will be a durably reliable connection between the actuating element 30 and the handle 20, said connection permanently withstanding even high loads and always matching different thicknesses of frames or door wings. On account of the biasing compression spring 80, the blocking elements 70 rest permanently and free of play against the corner edges 33 and at least in segments against the lateral faces 32 of the square bar 30. As soon as the attempt is made to move said bar in the direction R2, the permanently spring-biased operational components 30, 150, 76 of the blocking device 40 become operative, whereby the square bar 30 shall be stopped, i.e. fixed in position virtually without any play in displacement. Again, dimensional tolerances are negligible because of the simple design of the blocking device 40 within the handle 20, this feature being economical in manufacture.

If called for, the frictional and clamping effects may be enhanced further by configuring three or more clamping frames 71 on the square bar 30. As a result the anchoring in the blocking device 40 shall permanently withstand even extremely large applied loads.

To allow dismantling the operating mechanism 10, a continuous borehole 96 is radially fitted into the sidewall of the handle neck 23 allowing access to an omitted sharp tool fitted at its end with a slightly conical tip. The axial position of the borehole 96 substantially depends on the number and thickness of the clamping panes 71 when these enclose the square bar 30. Said axial position is selected in such a way that upon insertion of said sharp tool, the clamping panes 71 shall be displaced axially in the direction R1. When said panes then reach a position approximately parallel to the plane E, the square bar 30 can be simply and freely pulled out of the blocking device 40 and thereby the handle 20 can be removed from the square bar 30.

Figure 10:
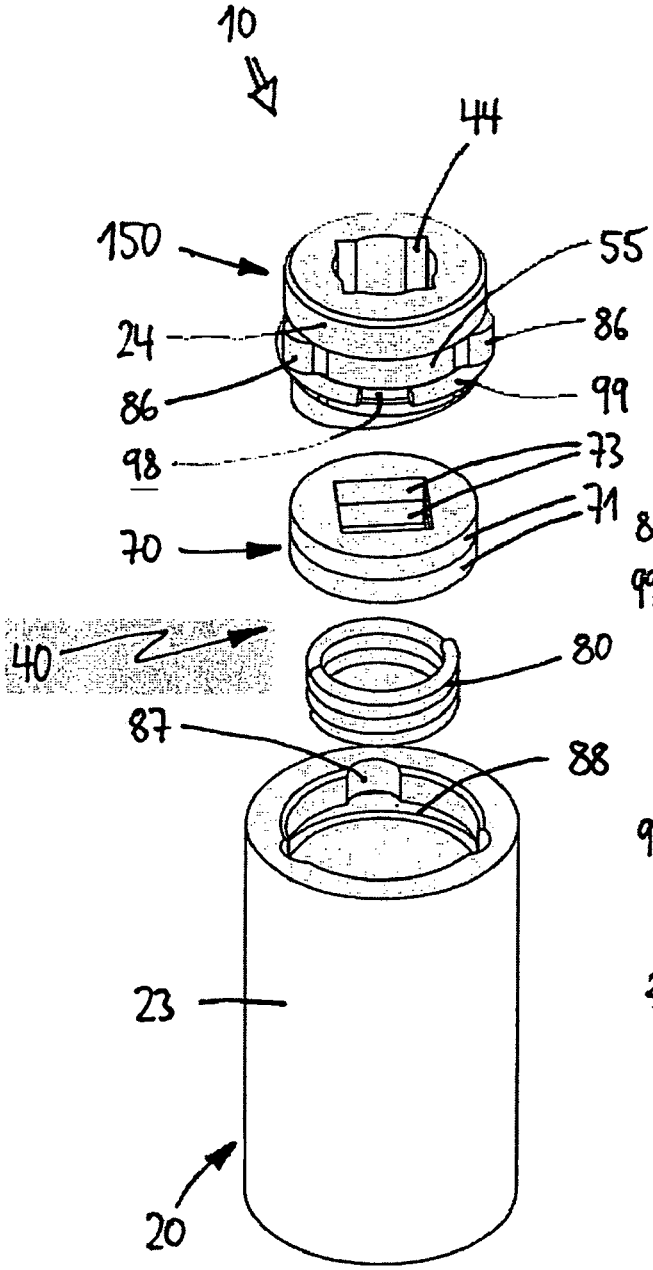
FIG. 10 shows the operating mechanism of FIG. 9 in exploded view.
Figure 9:
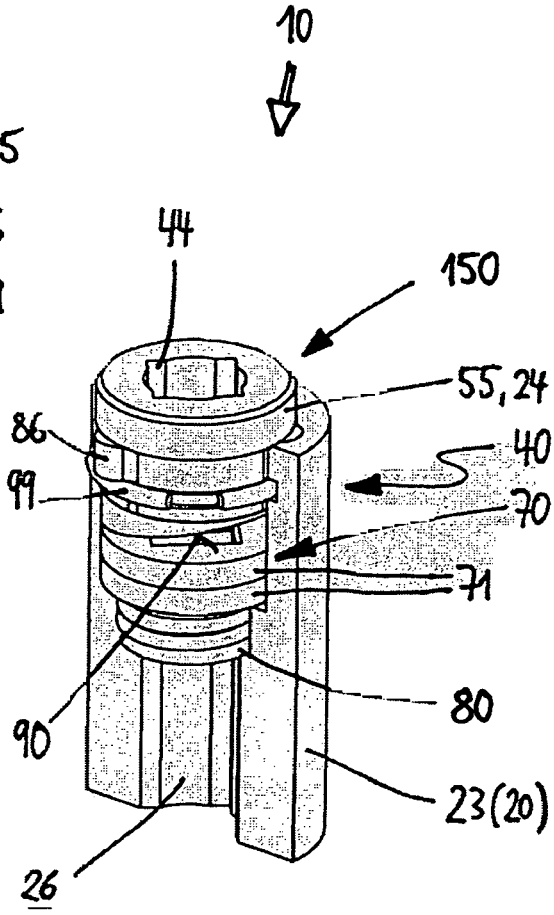
FIG. 9 is a partial oblique of a further design of an operating mechanism.

FIGS. 9 and 10 show a further embodiment mode of an operating mechanism of the invention.

Keeping the same the operations of the blocking device 40, in this embodiment mode the bush 150 is no longer fitted with an external thread 51, but instead with a circumferential groove 98 which receives in geometrically locking manner a snap spring 99. Accordingly the handle neck 23 lacks an inside thread and instead is fitted with a circumferential recess 88 which also may receive said snap ring 99 in geometrically locking manner.

This design allows affixing the bush 150 in the handle neck 23 in snap-in manner. Radially projecting ears or protrusions 86 are fitted on the outer periphery of the collar 55 to assure irrotationality, said ears/protrusions entering corresponding recesses 87 in the inner periphery of the handle neck 23 when axially installing the bush 150. This feature assures a firm connection between the bush 150 and the handle 20, said connection being able to transmit both the longitudinal traction and the torque in firm, geometrically interlocking manner between the two assembly partners.

Figure 11:
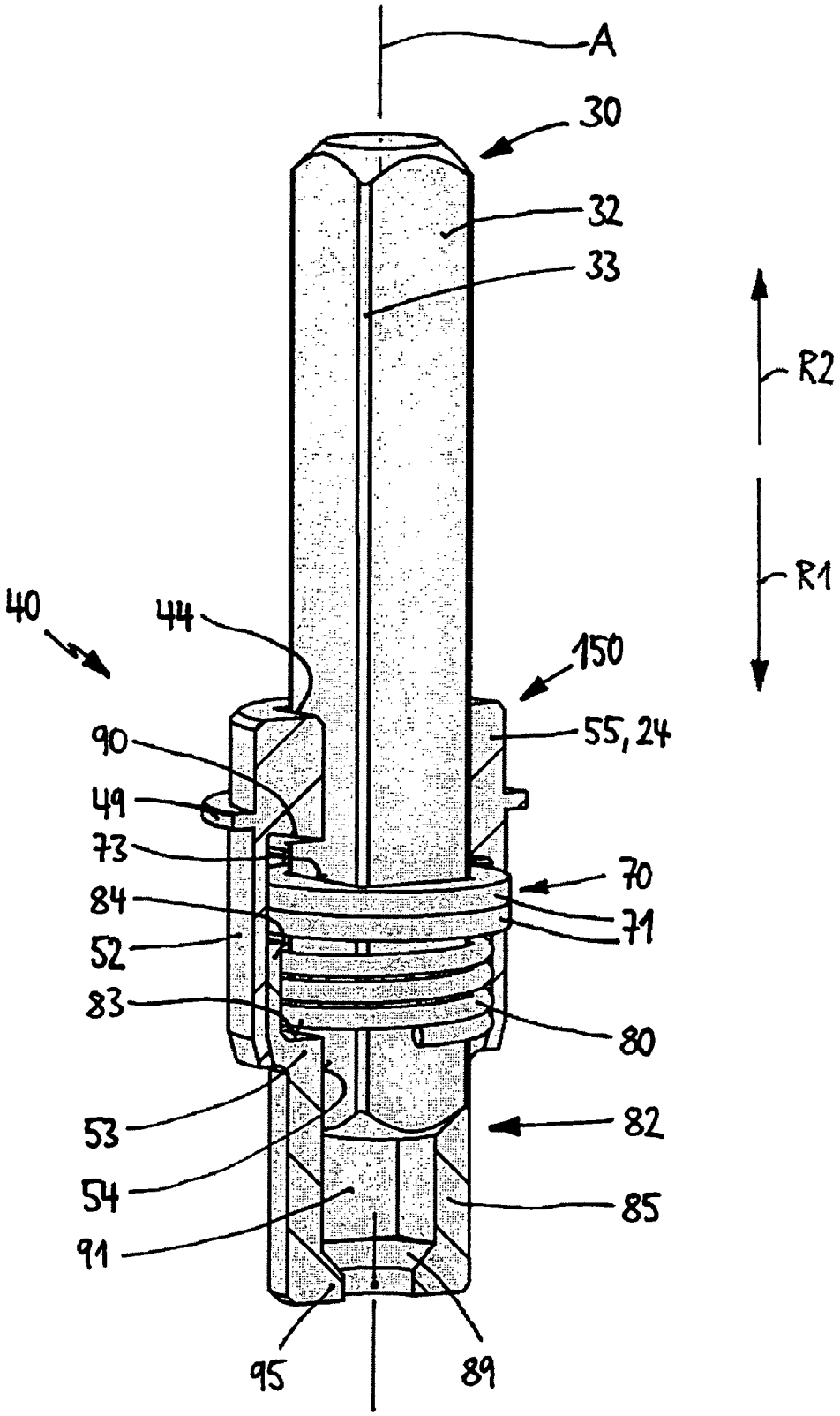
FIG. 11 shows another embodiment mode of an operating mechanism blocking device as a premounted component.

As regards a further embodiment mode of the operating mechanism 10 of the invention shown in FIG. 11, the blocking device 40 to affix the square bar 30 is designed as a pre-fabricated unit.

In this embodiment mode, the bush 150 comprises a cylindrical casing 52 fitted at its end situated in the handle neck 23 with a base 53 and at its end facing the door leaf with a collar 55. Said collar 55 rests by a radial lip 49 on the end surface 27 of the handle neck 23 (omitted here). Preferably however its dimensions are selected in a manner that it shall constitute the offset, i.e. the collar 24 of the handle 20.

The inside end surface of the collar 55 facing the handle neck 23 is fitted with an oblique surface 90 of which the slope runs diagonally to the cross-section of the square bar 30, respectively to a clearance 44 in the collar 55 receiving said bar in geometrically locking manner. The clearance 44 receives the square bar 30 so as to transmit torque in irrotational manner.

The base 53 of the bush 150 is constituted by a bush sub-structure 82 which is firmly affixed from below into the bush 150, i.e. into the cylindrical casing 52. This connection illustratively may be implemented by welding, bonding or flanging. However the sub-structure 82 also may be screwed into the bush 150. The bush substructure 82 however also may be screwed into the bush 150.

Together with the base 53, the bush substructure 82 constitutes a support surface 83 for the helical spring 80 which permanently biases two clamping frames 71 mounted thereabove in the direction R2. The clamping frames 71 constitute the blocking elements 70 of the blocking device 40. They rest at least by the edges against the oblique surface 90 and are supported by the bush substructure 82 which for that purpose is fitted with a cylindrical support edge situated above the base 53. The inside distance between the support edge 84 and the oblique surface 90 is selected in such manner that the clamping frames 71 may assume their oblique position relative to the square bar 30.

Below the base 53, the bush substructure 82 comprises a cylindrical extension 85 of which the inside surfaces 91 constitute a square-bar clearance 54 which is configured congruently with the clearance 44 in the collar 55 and which receives the square bar 30 in mutually irrotational and geometrically manner. The lower end of the said extension 85 constitutes a base surface 95 which is fitted with a countersink 89 centered on the longitudinal axis A.

It is understood that the bush 150 and the bush substructure 82 constitute a cartridge which is inserted at the end surface into the neck 23 of the handle 20. Affixation in a handle 20, which may be designed to be a pipe handle, illustratively can be by welding or bonding, however the cartridge 150, 82 shall preferably be screwed axially into a solid handle 20. For that purpose an omitted screw is inserted into the borehole 89 and is axially screwed into the neck 23 of the handle 20. Traction exerted on the handle 20 as a result is directly transmitted axially by the screw onto the cartridge 150, 82 and hence to the blocking device 40 and the square bar 30 locked therein. Access to the screw is through the clearances 44, 73 and the helical spring 80 prior to inserting the square bar 30. To assure unfailing torque transmission from the blocking device 40 to the handle 20, the external periphery of the bush 150, i.e. of the cylinder casing 52, is fitted with an omitted specified contouring. However radial protrusions 86 also may be used which engage congruent clearances 87 in the handle neck 23 (see FIGS. 9 and 10).

It is especially important that the blocking device 40 of the embodiment mode of FIG. 11 be prefabricated as an encapsulated subassembly and that it need only be screwed, pressed or bonded into the neck 23 of the handle 20. This feature simplifies more than just storage. Depending on customer's desiderata, the blocking device 40 may be fitted at the factory with any door or window handle. In this feature the square clearances 44 and 91 in the cartridge 150, 82 assume the guidance of the square bar 30 which, immediately upon its insertion into the bush 150, is then able to absorb/transmit torques. As a result the axial adjustment range of the bar connection has been enlarged.

The invention is not restricted to one of the above discussed embodiment modes, rather in can be modified in many ways. Illustratively the operating mechanism 10 also may be applied to door fittings that instead of a handle comprise a door knob (olive) or the like on one side of the door leaf. Moreover the operating mechanism 10 also may be a window handle.

As regards the embodiment modes shown in FIGS. 1 through 5, only two, or more than four blocking elements may be used. In the embodiment modes of FIGS. 9 through 11, only one (FIG. 6) or also two or more clamping panes 71 may be used. What must be paid attention to is that all the blocking elements 70 rest, free of play, against the lateral faces 32 or against the longitudinal edges 33 of the square bar 30 in order that, when a force is applied to said bar in the direction R2, the blocking action take place at once. Depending on the application, a combination of various blocking elements 70 also may be appropriate.

The blocking elements 70 furthermore may be designed as (omitted) pawls pivotably supported in the bush 50 and engaging by terminal claws or tips the lateral faces 32 or the edges 33 of the square bar 30.

To the extent they are part of the design, the grooves 34, channels or the like in the lateral faces 32 of the square bar 30 do not mandatorily require that they run parallel to the longitudinal axis A. The grooves 34 also may be configured transversely for instance in order to increase the frictional/clamping effect or to constitute indent offsets serving to insert the square bar 30 into the blocking device 40.

Where appropriate, the blocking device 40 also may be integrated into the handle 20 for instance by the bush 50 being integral with handle neck 23.

It is understood that said blocking devices be designed to be rotationally symmetrical (FIGS. 1 through 5) or mirror symmetrical (FIGS. 6 through 11) relative to the longitudinal axis A. This feature is advantageous beyond manufacturing costs. The installation of the operating mechanism 10 per se is exceedingly simple because all components need only be assembled axially.

Following its insertion into the blocking device 40, the square bar 30 is peripherally enclosed by blocking or clamping elements 70 situated approximately at the same height. The blocking elements 70 may be configured in a radial aperture 65 of a guide element 60 guided axially within the bush 50. Appropriately one blocking element 70 is provided for each lateral face 32 of the square bar 30, that is, said blocking elements 70 are peripherally apart by 90° intervals. The blocking elements 70 are enclosed by the conical borehole 59 or by the individual oblique surfaces 58. The circular cylindrical casing 52 is fitted with a collar 55 by means of which the bush 50 rests on the end surface 27 of the handle neck 23. A square clearance 54 in the base 53 of the bush 50 receives the square bar 30 in geometrically locking, torque-transmitting manner.

A compression spring 80 rests on the base 53 of the bush 50 and permanently biases the guide element 60. As a result the blocking elements 70 are forced permanently in-between the conical borehole 59 and the lateral faces 32 of the square bar 30. If traction is exerted on the square bar 30 in the direction R2, and should the blocking elements 70 tend to roll off along the conical borehole 59, i.e. the oblique surfaces 58, they are prevented from doing so because the surfaces 32, 58 or 59 are not parallel to each other. The blocking elements 70 are clamped between the bush 50 and the square bar 30.

It is understood that the blocking device 40 locks up in axial, continuous and frictional manner. This feature allows easy insertion of the square bar 30 in the direction R1. In the opposite direction R2, however, any incipient displacement of the square bar 30 is immediately blocked/stopped within said blocking device 40 itself. The angle $\alpha$ between the oblique surfaces 58, 59 and the lateral faces 32 of the square bar 30 is selected in such a way that an adequate clamping force shall be generated and that in the absence of the square bar 30, the guide element 60 is prevented from slipping out of the bush 50.

The extremely simple and easily installed operating mechanism 10 offers a further advantage in that it allows immediately using pre-existing substructures such as roses, door plates and the like. On-site changes or adaptations are not required. At the same time, the rapid installation is augmented by the advantage, unnoticeable to the user, that any door or window thickness is automatically accommodated when the pair of handles or the door handle 20 is installed to rest against the door rose or plate.

LIST OF REFERENCES

A longitudinal axis/axial direction
E plane
A angle
R1 first direction
R2 opposite direction
10 operating mechanism
20 handle
21 upper step
22 main handle part
23 handle neck
24 offset/handle collar
25 clearance
26 inside part
27 end surface
28 step
29 inside thread
30 actuating element/square bar
32 lateral face
33 corner edges
34 channel/longitudinal groove
40 blocking device
44 clearance
45 clearance
48 lip
49 lip
50 bush
150 bush
51 outside thread
52 cylindrical casing
53 base
54 clearance
55 collar
56 top edge
57 inside periphery
58 oblique surface
59 conical peripheral surface
60 guide element
61 external periphery
62 inside periphery
64 channel
65 aperture
70 blocking element
71 clamping frame
72 sphere
73 clearance
75 support edge
77 top side
80 spring
82 bush substructure
83 support surface
84 support edge
85 extension
86 protrusion
87 clearance
88 recess

89 countersink
90 oblique surface
91 square bar clearance
92 further step
94 lower step
95 base surface
96 continuous borehole
98 peripheral groove
99 clip-on ring

The invention claimed is:

1. An operating mechanism for removably securing a handle to a spindle in a mutually irrotational manner without requiring a tool, wherein the handle has a cavity located therein for housing said operating mechanism, said operating mechanism comprising:

a first member for installation into the cavity in the handle, said first member having a first aperture extending axially therethrough, the first aperture configured to receive an end of the spindle inserted through said first aperture and into the cavity in the handle, said first member also having an operating surface oriented toward the interior of the cavity in the handle when said first member is installed into the cavity in the handle, said operating surface of said first member comprising an oblique surface that is diagonal with respect to the axis of the spindle as it is installed into said operating mechanism;

a clamping element for placement in the cavity in the handle; and a biasing element for placement in the cavity in the handle, said biasing element urging said clamping element toward said operating surface of said first member, wherein the end of the spindle may be freely inserted axially through said first aperture in said first member and into engagement with said clamping element without the use of a tool following which removal of the spindle in an axial opposite direction from said operating mechanism and the handle is blocked;

wherein said clamping element comprises at least one clamping member having a generally annular configuration and having a third aperture extending therethrough, said third aperture being sized to admit the spindle therethrough with sufficient space to allow said at least one clamping member to be driven by said biasing element to pivot on said oblique surface to an angular position with respect to the spindle to cause said at least one clamping member to engage the spindle in a gripping manner after the spindle has been inserted through said third aperture in said at least one clamping member, thereby preventing the removal of the spindle from said operating mechanism and the handle.

2. An operating mechanism as defined in claim 1, wherein said first member is installed in the cavity in the handle in a mutually irrotational manner.

3. An operating mechanism as defined in claim 1, wherein said first member is arranged and configured such that the spindle when inserted through said first aperture in said first member is received in a mutually irrotational manner.

4. An operating mechanism as defined in claim 1, wherein said clamping element is configured to engage the spindle in one of a pressure-locking, geometrically locking, and frictionally locking manner.

5. An operating mechanism as defined in claim 1, wherein said clamping element is driven by the spindle when the spindle is inserted through said first aperture in said first member and into engagement with said clamping element.

6. An operating mechanism as defined in claim 1, wherein said clamping element is arranged and configured to prevent the spindle from being withdrawn following the spindle having been inserted through said first aperture in said first member and into engagement with said clamping element.

7. An operating mechanism as defined in claim 1, wherein the spindle has a square cross-sectional configuration and wherein at least a portion of said first aperture has a square cross-sectional configuration of a configuration to receive the spindle therein in a mutually irrotational manner.

8. An operating mechanism as defined in claim 7, wherein said clamping element is arranged and configured to receive said spindle in a manner wherein said clamping element cooperate with and/or engage at least one lateral face of the spindle.

9. An operating mechanism as defined in claim 1, wherein said clamping element is arranged and configured to cooperate with and/or engage at least one corner edge of the spindle.

10. An operating mechanism as defined in claim 1, wherein said biasing element comprises a spring.

11. An operating mechanism as defined in claim 10, wherein said spring is located in a position which allows the spindle to pass therethrough as the spindle as it is installed into said operating mechanism.

12. An operating mechanism as defined in claim 1, wherein said clamping element is supported in a pivotable manner.

13. An operating mechanism as defined in claim 12, wherein said clamping element pivots about an axis that is orthogonal to the axis of the spindle as it is installed into said operating mechanism.

14. An operating mechanism as defined in claim 1, wherein said operating mechanism is preassembled into the handle.

15. An operating mechanism as defined in claim 1, wherein said operating surface of said first member comprises:

a substantially planar surface oriented at an angle with respect to the axis of the spindle as it is installed into said operating mechanism.

16. An operating mechanism as defined in claim 15, wherein said operating surface of said first member comprises a second aperture extending therethrough to admit the spindle as it is installed into said operating mechanism.

17. An operating mechanism as defined in claim 1, wherein said clamping element comprises:

at least one clamping member which encloses the spindle after the spindle has been inserted through said first aperture in said first member and into engagement with said clamping element.

18. An operating mechanism as defined in claim 1, wherein said clamping element additionally comprises:

at least one additional clamping member substantially identical to said at least one clamping member, said at least one additional clamping member being located adjacent to said at least one clamping member.

19. An operating mechanism as defined in claim 1, additionally comprising:

a second member for installation into the cavity in the handle prior to the insertion of said biasing element, said clamping element, and said first element, said second member having a fourth aperture extending axially therethrough wherein the end of the spindle may be inserted through said fourth aperture and into the cavity in the handle when said second member is installed into the cavity in the handle, wherein said biasing element is located intermediate said second member and said biasing element.

20. An operating mechanism as defined in claim 19, wherein said second member is engaged by and partially located within said first member when said first and second members are installed into the cavity in the handle.

21. An operating mechanism as defined in claim 1, wherein said first member is screwed, pressed, or bonded into the cavity in the handle.

22. An operating mechanism as defined in claim 1, wherein the handle has a tool access aperture located orthogonal to the cavity in the handle through which a tool may be inserted to engage said clamping element to allow the spindle to be withdrawn from said operating mechanism and the handle.

23. An operating mechanism for removably securing a handle to a spindle in a mutually irrotational manner without requiring a tool, wherein the handle has a cavity located therein for housing said operating mechanism, said operating mechanism comprising:

a first member for installation into the cavity in the handle in an irrotational manner with respect to the handle, said first member having a first aperture extending axially therethrough, the first aperture configured to receive an end of the spindle may be inserted through said first aperture and into the cavity in the handle, said first member also having an oblique surface oriented toward the interior of the cavity in the handle when said first member is installed into the cavity in the handle, said oblique surface being diagonal with respect to the axis of the spindle as it is installed into said operating mechanism;

a first clamping element configured for placement in the cavity in the handle;

a second clamping element configured for placement in the cavity in the handle adjacent to said first clamping element;

a biasing element for placement in the cavity in the handle, said biasing element urging said first and second clamping elements toward said oblique surface of said first member, wherein the end of the spindle may be freely inserted axially through said first aperture in said first member and into engagement with said first and second clamping elements without the use of a tool following which removal of the spindle in an axial opposite direction from said operating mechanism and the handle is blocked; and a second member for installation into the cavity in the handle prior to the insertion of said biasing element, said first and second clamping elements, wherein said first and second clamping elements are located intermediate said second member and said biasing element.

24. A method of removably securing a handle to a spindle in a mutually irrotational manner without requiring a tool, wherein the handle has a cavity located therein for housing said operating mechanism, said method comprising:

placing a clamping element in the cavity in the handle;

installing a first member into the cavity in the handle, said first member having a first aperture extending axially therethrough wherein an end of the spindle is configured for insertion through said first aperture and into the cavity in the handle, said first member also having an operating surface oriented toward the interior of the cavity in the handle when said first member is installed into the cavity in the handle, said operating surface of said first member having an oblique surface that is diagonal with respect to the axis of the spindle as it is installed into said operating mechanism; and biasing said clamping element toward said operating surface of said first member, wherein the end of the spindle may be freely axially inserted through said first aperture in said first member and into engagement with said clamping element without the use of a tool following which removal of the spindle in an axial opposite direction from said operating mechanism and the handle is blocked;

wherein said clamping element comprises at least one clamping member having a generally annular configuration and having a third aperture extending therethrough, said third aperture being sized to admit the spindle therethrough with sufficient space to allow said at least one clamping member to be driven by said biasing element to pivot on said substantially planar surface to an angular position with respect to the spindle to cause said at least one clamping member to engage the spindle in a gripping manner after the spindle has been inserted through said third aperture in said at least one clamping member, thereby preventing the removal of the spindle from said operating mechanism and the handle.

* * * * *